US009250596B2

(12) United States Patent
Nagao

(10) Patent No.: US 9,250,596 B2
(45) Date of Patent: Feb. 2, 2016

(54) IMAGE FORMING APPARATUS

(71) Applicant: Konica Minolta, Inc., Chiyoda-ku, Tokyo (JP)

(72) Inventor: Shinichi Nagao, Koganei (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/553,112

(22) Filed: Nov. 25, 2014

(65) Prior Publication Data

US 2015/0145938 A1 May 28, 2015

(30) Foreign Application Priority Data

Nov. 28, 2013 (JP) ..... 2013-245518

(51) Int. Cl.

| | |
|---|---|
| ***B41J 2/435*** | (2006.01) |
| ***B41J 2/47*** | (2006.01) |
| ***G03G 15/00*** | (2006.01) |
| ***G03G 15/04*** | (2006.01) |
| ***G03G 15/043*** | (2006.01) |

(52) U.S. Cl.

CPC ..... *G03G 15/55* (2013.01); *G03G 15/0409* (2013.01); *G03G 15/0435* (2013.01)

(58) Field of Classification Search

CPC ..... G03G 2215/00029; G03G 2215/00042; G03G 2215/00054; G03G 2215/0158; G03G 2215/0161; G03G 2215/0164

USPC ..... 347/232, 234, 240, 241, 244, 248, 249, 347/251–254, 256, 258

See application file for complete search history.

(56) References Cited

U.S. PATENT DOCUMENTS

| | | | | |
|---|---|---|---|---|
| 6,349,185 | B1 * | 2/2002 | Burkes | G03G 15/0194 399/49 |
| 2008/0112007 | A1 * | 5/2008 | Yamada | G03G 15/0178 358/1.15 |
| 2010/0033775 | A1 * | 2/2010 | Miyanagi | G02B 5/08 358/505 |

FOREIGN PATENT DOCUMENTS

| | | | |
|---|---|---|---|
| JP | 2008096592 | A | 4/2008 |

* cited by examiner

*Primary Examiner* — Hai C Pham
(74) *Attorney, Agent, or Firm* — Cantor Colburn LLP

(57) ABSTRACT

An image forming apparatus includes a vibration adjustment unit which adjusts a natural frequency of an optical system, a measuring unit which measures vibrational information indicating change in vibration, and a controller which individually drives each unit. The measuring unit measures the vibrational information after the natural frequency is adjusted to a drive frequency of each unit at an initial state. The controller stores this vibrational information as initial vibrational information. The measuring unit measures the vibrational information after the natural frequency is adjusted to a drive frequency of a unit to be checked. The controller compares this vibrational information with the initial vibrational information measured after adjustment of the natural frequency to the drive frequency of the unit to be checked. The controller determines abnormality in the unit to be checked according to the comparison.

10 Claims, 11 Drawing Sheets

T

| T1 UNIT | | T2 FREQUENCY | T3 MEASUREMENT TIMING | | | | |
|---|---|---|---|---|---|---|---|
| | | | 0kp | 20kp | 40kp | ··· | 120kp |
| DRUM DRIVING | A | 315Hz | ○ | | ○ | | ○ |
| | B | 360Hz | ○ | ○ | ○ | | ○ |
| DEVELOPMENT DRIVING | A | 380Hz | ○ | | | | ○ |
| | B | 420Hz | ○ | ○ | ○ | | ○ |
| SHEET FEEDER DRIVING | A | 155Hz | ○ | | | | ○ |
| | B | 200Hz | ○ | | | | ○ |

IMAGE FORMING APPARATUS

The present invention claims priority under 35 U.S.C. §119 to Japanese Application No. 2013-245518 filed Nov. 28, 2013, the entire content of which is incorporated herein by reference.

BACKGROUND OF THE INVENTION

1. Field of the Invention

The present invention relates to an image forming device.

2. Description of Related Art

A well-known conventional image forming apparatus forms a toner image on an image carrier such as a photosensitive drum through an electrophotographic process including charging, exposing, and developing, then forms the toner image on a print sheet, and fixes the toner image on a print sheet with a fixing device (e.g., Japanese Patent Application Laid-Open No. 2008-96592).

In a conventional image forming apparatus, when vibration increases due to, for example, degrading of units including a driving system or change in condition of processing system, and the vibration is transferred to an exposure unit, an optical element in the exposure unit resonates to cause image defect such as unevenness of image pitch (banding) and color registration errors, or the like. To detect occurrence of such image defects, it is required to print out and check a print sheet with an image printed thereon, or attach a vibration detecting device to monitor chronological change in vibration.

However, even by printing and checking the print sheet or by monitoring chronological change in vibration, the unit causing the increase in vibration cannot be detected. Thus, the unit still not reaching the service life without any problem is unnecessarily replaced. This disadvantageously raises service cost.

SUMMARY OF THE INVENTION

The present invention is made in view of the problem described above. The object of the present invention is to provide an image forming apparatus that can prevent increase in service cost.

In order to achieve at least one of the objects, according to one aspect of the present invention, there is provided an image forming apparatus including an optical unit including a light source and an optical system which focuses light emitted from the light source onto a photosensitive body, the apparatus including:

a vibration adjustment unit which adjusts a natural frequency of the optical system;

a measuring unit which measures vibrational information indicating change in vibration;

a controller which independently drives each of units including a predetermined drive system; and a memory unit which stores a drive frequency of each of the units including the predetermined drive system, wherein the controller includes:

a first measurement control unit which controls the measuring unit to measure the vibrational information after the vibration adjustment unit adjusts the natural frequency of the optical system to a drive frequency of each unit, which is stored in the memory unit, at an initial state;

an initial value memory control unit which stores the vibrational information measured through control of the first measurement control unit in the memory unit as initial vibrational information;

a second measurement control unit which controls the measuring unit to measure the vibrational information after the vibration adjustment unit adjusts the natural frequency of the optical system to a drive frequency of a unit to be checked, which is stored in the memory unit;

a comparing unit which compares the vibrational information measured through control of the second measurement control unit and the initial vibrational information measured after adjustment of the natural frequency of the optical system to the drive frequency of the unit to be checked among the stored initial vibrational information; and an abnormality determination unit which determines abnormality in the unit to be checked according to comparison made by the comparing unit.

Preferably, in the image forming apparatus, the vibrational information is an amount of change of sub-scanning position of the light, and the second measurement control unit controls the measuring unit to measure the amount of change of sub-scanning position while driving the drive system included in the unit to be checked.

Preferably, in the image forming apparatus, the measuring unit is a synchronizing sensor included in the optical unit.

Preferably, in the image forming apparatus, the controller controls a timing of emission of light from the light source such that the light does not reach the photosensitive body when the second measurement control unit controls the measuring unit to measure the amount of change of sub-scanning position.

Preferably, the image forming apparatus further includes a shutter provided between the optical unit and the photosensitive body to control passing of the light, and the controller controls the shutter such that the light does not reach the photosensitive body when the second measurement control unit controls the measuring unit to measure the amount of change of sub-scanning position.

Preferably, in the image forming apparatus, the vibrational information is density change of an image printed on a print sheet.

Preferably, in the image forming apparatus, the measuring unit is an in-line sensor which reads the image printed on the print sheet while the sheet is being delivered.

Preferably, in the image forming apparatus, the measuring unit measures density change of images printed on a single print sheet, each of the images corresponding to each of the units and being printed after the natural frequency of the optical system is adjusted to the drive frequency of each of the units.

Preferably, in the image forming apparatus, the memory unit stores the drive frequency and a measurement timing associated to each of the units, and the controller controls the second measurement control unit to perform control according to the measurement timing.

Preferably, in the image forming apparatus, the measurement timing is associated to an accumulated total number of sheets printed since installation of a machine.

BRIEF DESCRIPTION OF THE DRAWINGS

The present invention will become more fully understood from the detailed description given hereinafter and the appended drawings, which are given by way of illustration only and thus are not intended as a definition of the limits of the present invention, wherein.

DETAILED DESCRIPTION OF PREFERRED EMBODIMENTS

Preferred embodiments for carrying out the present invention will be described using the attached drawings.

Figure 1:
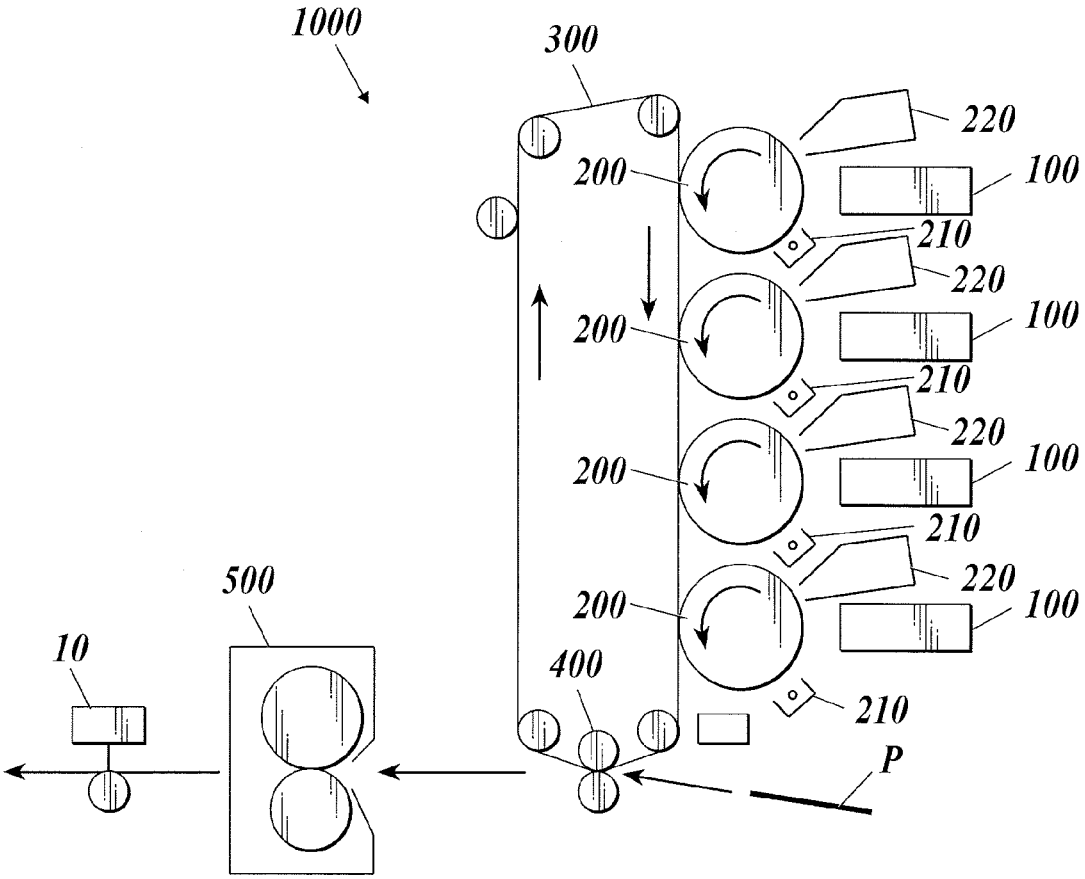
FIG. 1 illustrates a schematic configuration of an image forming apparatus according to an embodiment.

An image forming apparatus 1000 according to an embodiment is used as, for example, a laser printer or a digital copying machine. As illustrated in FIG. 1, the image forming apparatus 1000 includes a plurality of laser scanning optical units 100 provided for each of colors, that is, cyan, magenta, yellow, and black, a photosensitive body 200 such as a photosensitive drum corresponding to the laser scanning optical unit 100, a charging unit 210 for charging the photosensitive body 200, a developer 220 for supplying developer to the photosensitive body 200 irradiated with a laser beam so that the an electrostatic latent image is developed into a visible image with the developer, an intermediate transfer belt 300, a transfer roller 400 for transferring the image developed with the developer to a recording medium, a fixing unit 500 for fixing the image, developed with the developer, transferred with the transfer roller 400 onto the recording medium, an in-line sensor 10, and a controller 600 (see FIG. 5).

The image forming apparatus 1000 supplies the developer to the photosensitive body 200 on which the electrostatic latent image is formed by irradiation with a laser beam emitted from the laser scanning optical unit 100 so that the electrostatic latent image is developed into a visible image with the developer, and then transfers the image developed with the developer onto the intermediate transfer belt 300. The image forming apparatus 1000 then pressingly transfers the image developed with the developer, which is transferred on the intermediate transfer belt 300, onto a print sheet P as a recording medium, with a transfer roller 400. The print sheet P is then heated and pressed with the fixing unit 500 to fix the image developed with the developer onto the print sheet P. The image forming apparatus 1000 then delivers the print sheet P with a paper ejection roller (not shown in the drawing) or the like and ejects the print sheet P to a tray (not shown in the drawing). The image forming process is thus carried out.

The in-line sensor 10 is arranged in the downstream of the fixing unit 500 along the delivering direction. The in-line sensor 10 reads an image printed on the print sheet P using an image sensor such as a CCD while the sheet is being delivered. For example, the in-line sensor 10 obtains image information to correct image density when forming images or to suitably adjust conditions for forming images.

Further, the in-line sensor 10 works as a measuring unit to measure the density change of an image printed on the print sheet P.

Figure 2:
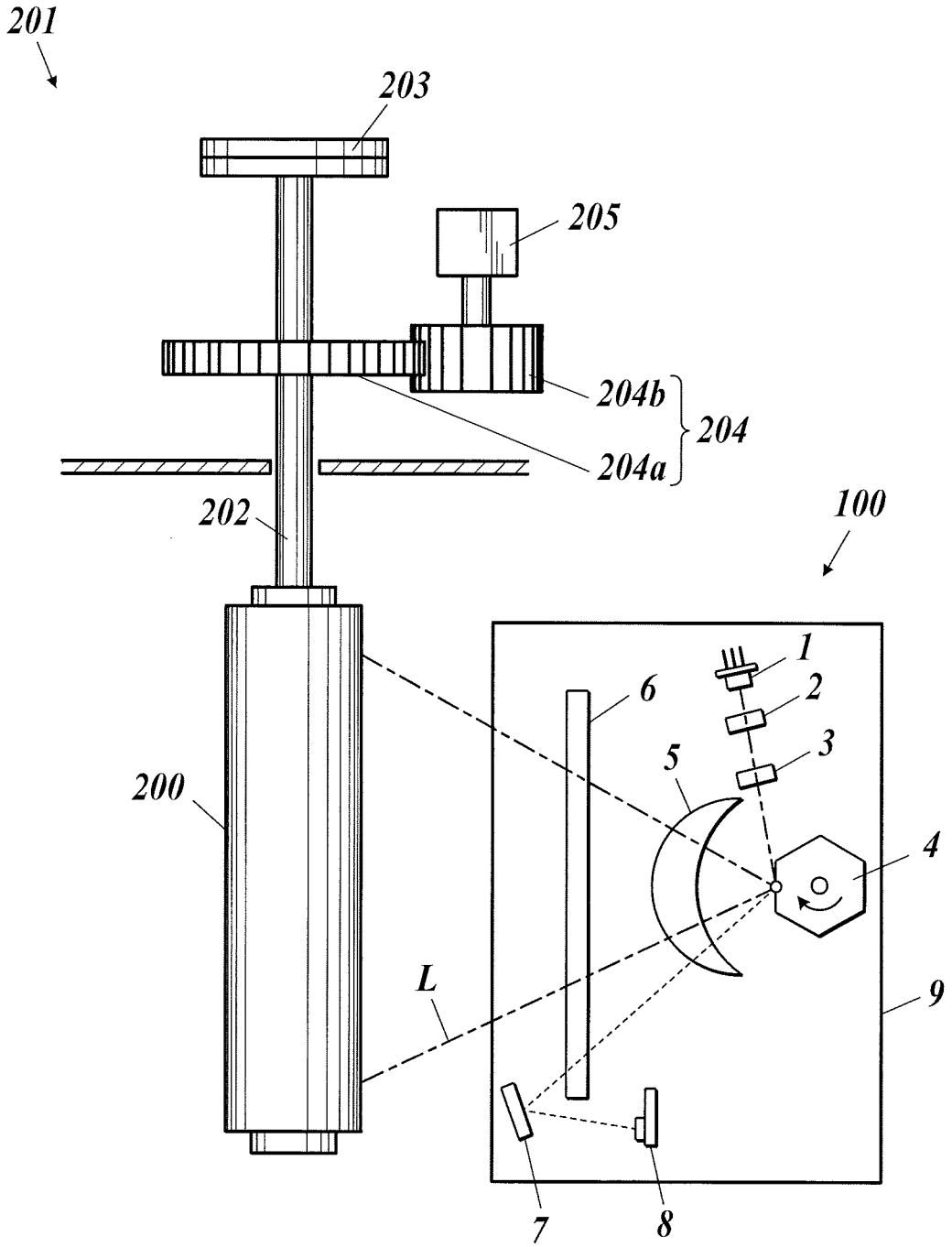
FIG. 2 illustrates a schematic configuration of a laser scanning optical unit, a photosensitive body, and a drum driver according to the embodiment.

As illustrated in FIGS. 1 and 2, the laser scanning optical unit 100 irradiates the photosensitive body 200 charged by the charging unit 210 with a laser beam L to form an electrostatic latent image on the photosensitive body 200. The laser scanning optical unit 100 includes a light source 1 that emits the laser beam L, a first optical system 2 that collimates the laser beam L emitted from the light source 1, a second optical system 3 that converges only a component in the sub-scanning direction of the laser beam L which passes through the first optical system 2, a deflector 4 that deflects the laser beam L passing through the second optical system 3, a third optical system 5 and a fourth optical system 6 that focus the laser beam L deflected by the deflector 4 on the photosensitive body 200, a fifth optical system 7 that reflects the laser beam L deflected by the deflector 4, and a synchronizing sensor 8 that inputs the laser beam L reflected at the fifth optical system 7. The laser scanning optical unit 100 includes an optical housing 9 which supports components described above.

The light source 1 is a semiconductor laser for emitting the laser beam L. The first optical system 2 is irradiated with the laser beam L emitted from the light source 1.

The first optical system 2 including a collimator lens converts the laser beam L emitted from the light source 1 from diverging light into parallel light.

The second optical system 3 includes a slit and a cylindrical lens. Further, a slit is provided in the second optical system 3 to restrict the transmission amount of laser beam L, which has been converted into a parallel light by the first optical system 2, so that a beam spot is formed on the photosensitive body 200. Furthermore, the second optical system 3 converges the laser beam L, which has been converted into a parallel light by the first optical system 2, in the sub-scanning direction through the cylindrical lens.

The deflector 4 includes a polygon mirror formed in a polygonal column having mirror-surface sides and a motor for providing a rotational force to the polygon mirror to rotate the polygon mirror. The deflector 4 deflects the laser beam L, which has passed through the second optical system 3, to the direction corresponding to the rotation. Further, the deflector 4 irradiates the peripheral surface of the photosensitive body 200 with the deflected laser beam L via the third optical system 5 and the fourth optical system 6. The deflector 4 enables scanning of the laser beam L along the main scanning direction (longitudinal direction of the photosensitive body 200 in FIG. 2) to irradiate the photosensitive body 200 with the laser beam L at a different location in the longitudinal direction according to the rotational position.

The third optical system 5 and the fourth optical system 6 focus the laser beam L deflected by the deflector 4 on the surface of the photosensitive body 200 to form an image. Further, as illustrated in FIG. 3, the fourth optical system 6 includes a long optical element 61 which focuses the laser beam L on the surface of the photosensitive body 200, an optical element holder 62 which holds the optical element 61, and a vibration adjustment unit 63 which adjusts a natural frequency by applying an external force to the optical element holder 62.

Figure 3:
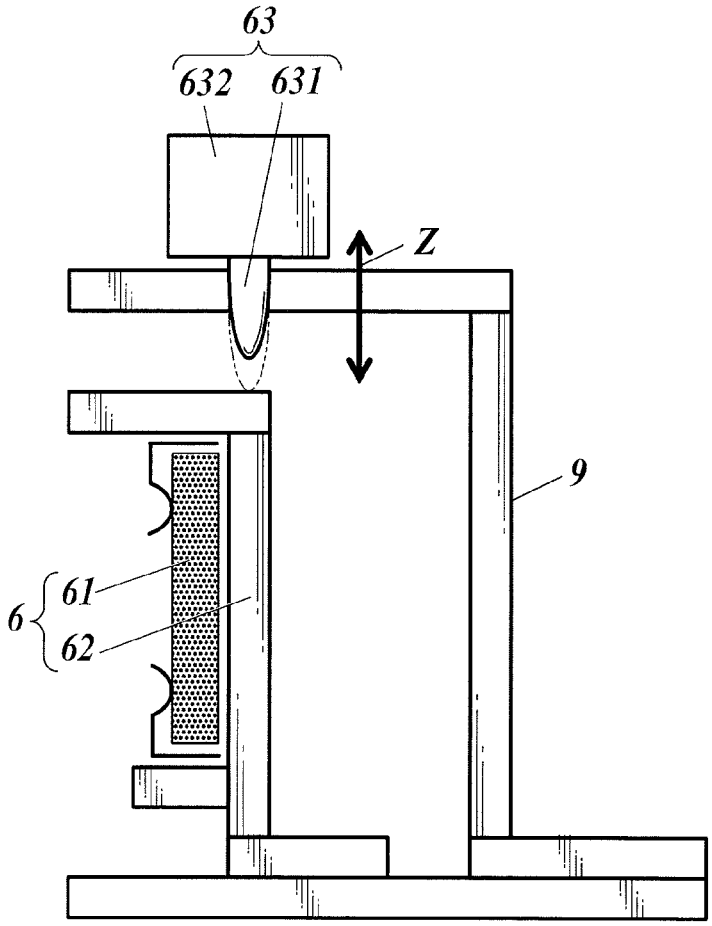
FIG. 3 illustrates a schematic configuration of a fourth optical system and a vibration adjustment unit according to the embodiment.

The vibration adjusting unit 63 includes a moving unit 631 slidable in the direction parallel to the optical surface of the optical element 61 (Z direction in FIG. 3) and a linear motor 632 that advances/retreats the moving unit 631 in Z direction in FIG. 3. The vibration adjustment unit 63 advances the moving unit 631 in Z direction in FIG. 3 by the linear motor 632 to apply an external force to the optical element holder 62 holding the optical element 61, thereby adjusting the natural frequency of the fourth optical system 6 to a desired driving frequency.

The fifth optical system 7 includes an optical mirror. Further, the fifth optical system 7 reflects the laser beam L deflected by the deflector 4 so that the reflected laser beam L enters the synchronizing sensor 8.

Figure 4:
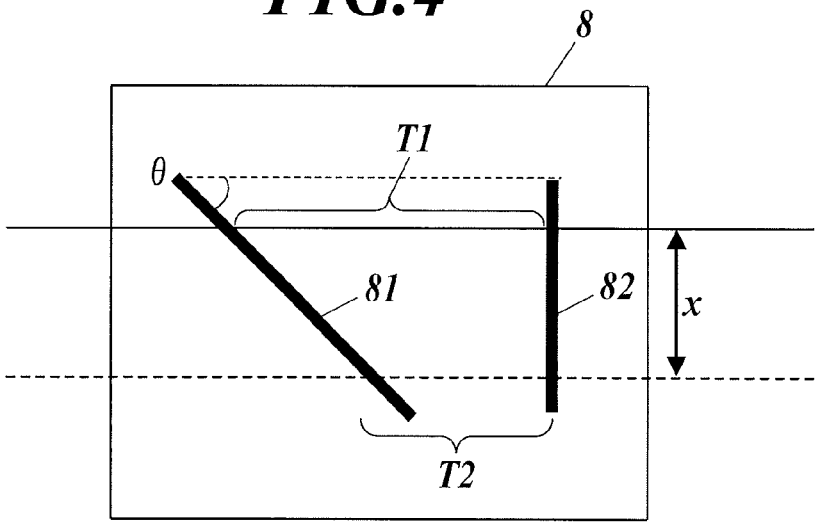
FIG. 4 illustrates a schematic configuration of a synchronizing sensor according to the embodiment.

As illustrated in FIG. 4, the synchronizing sensor 8 includes two line sensors 81 and 82 which detect the laser beam L reflected at the fifth optical system 7. The line sensor 82 is arranged such that the longitudinal direction is perpendicular to the entering laser beam L. The line sensor 81 is arranged so as to tilt against the line sensor 82 by θ degrees. The controller 600 of the image forming apparatus 1000 including the laser scanning optical unit 100 adjusts timings, for example, where to start writing on the photosensitive body 200, based on a detection signal detected by the synchronizing sensor 8.

Further, the synchronizing sensor 8 works as a measuring unit to measure an amount of change of sub-scanning position of the entering laser beam L. The change of sub-scanning position of the laser beam L is vibrational information indicating the change in vibration. In the embodiment, the change in vibration can be detected by using the amount of change of sub-scanning position of the laser beam L. The amount of change of sub-scanning position x of the laser beam L can be expressed in Equation 1, where Visa scanning speed of the laser, and T1 and T2 are periods of time which the laser beam L takes to pass through gaps between the line sensors 81 and 82.

$$x = V(T1 - T2) \times \tan\theta \qquad \text{Equation 1}$$

As illustrated in FIG. 2, the drum driver 201 drives the photosensitive body 200. The drum driver 201 includes a rotation shaft 202 rotatably supporting the photosensitive body 200, a flywheel 203 attached to one end portion of the rotation shaft 202 to reduce unevenness in rotational speed of the rotation shaft 202, a drum driving gear 204 which is attached to the rotation shaft 202 and configured with a first gear 204*a* which rotates the rotation shaft 202 and a second gear 204*b* arranged to mesh with the first gear 204*a*, and a drum driving motor 205 attached to the second gear 204*b* to rotate the second gear 204*b*.

The photosensitive body 200 is rotatably driven by the drum driving motor 205 rotating the second gear 204*b* to rotate the first gear 204*a* and the rotation shaft 202.

Figures 5, 6:
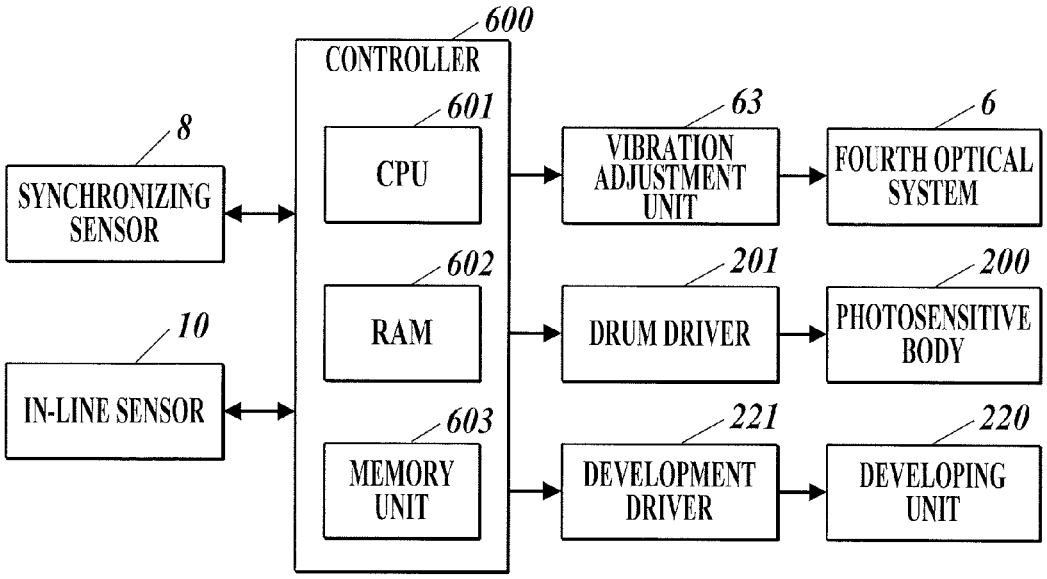
FIG. 5 is a block diagram illustrating a configuration for controlling the image forming apparatus according to the embodiment.
FIG. 6 illustrates an example of a drive frequency memory table.

As illustrated in FIG. 5, the controller 600 includes a CPU 601, RAM 602, and a memory unit 603 and performs predetermined operational control by executing predetermined programs stored in the memory unit 603.

The CPU 601 reads a processing program or the like stored in the memory unit 603, extracts the processing programs in the RAM 602 to execute the processing programs, and thereby controls the whole image forming apparatus 1000.

The processing program or the like executed by the CPU 601 is extracted in a program storage region in the RAM 602, and input data and processed results produced by execution of the processing programs are stored in a data storage region of the RAM 602.

The memory unit 603 includes, for example, a recording medium (not shown in the drawing) for storing programs and data. The recording medium is configured of semiconductor memory or the like. Further, the memory unit 603 stores various kinds of data used by the CPU 601 to control the whole image forming apparatus 1000, various processing programs, and data processed through execution of the programs.

Furthermore, the memory unit 603 stores a drive frequency memory table T. As illustrated in FIG. 6, in the drive frequency memory table T, a unit name T1 which is the name of a unit including a predetermined drive system, a drive frequency T2 of each unit, and a measurement timing T3 to measure the frequency of each unit are associated with each other. That is, the memory unit 603 stores the drive frequency T2 and the measurement timing T3 associated with each unit. In the embodiment, the measurement timing T3 is associated with the accumulated total number of sheets printed since the installation of the machine.

The memory unit 603 stores the amount of change of sub-scanning position of the laser beam L measured by the synchronizing sensor 8 or density change of an image measured by the in-line sensor 10.

For example, the controller 600 controls the vibration adjustment unit 63 to adjust the natural frequency of the fourth optical system 6 to a desired drive frequency.

Further, the controller 600 controls the synchronizing sensor 8 to measure the amount of change of sub-scanning position of the laser beam L entering the synchronizing sensor 8 and stores the measured result in the memory unit 603.

Further, the controller 600 controls the drum driver 201 to rotatably drive the photosensitive body 200. Furthermore, the controller 600 controls the development driver 221 to control the driving of the developer 220. That is, the controller 600 can independently drive each of a plurality of units including a predetermined drive system.

Further, the controller 600 controls the in-line sensor 10 to measure the density change of the image, which is read by the in-line sensor 10 when a sheet is delivered, and stores the measured result in the memory unit 603.

Now, the operation of the image forming apparatus 1000 according to the embodiment will be described referring to a flowchart in FIG. 7.

The controller 600 first switches on the vibration detection mode (Step S1). Specifically, the controller 600 switches on the vibration detection mode at an initial state, for example, when installation of the image forming apparatus 1000 has completed. The controller 600 decides that the installation of the image forming apparatus 1000 has completed by, for example, detecting a signal indicating the completion of installation of the image forming apparatus 1000, which signal being input by a user or a service personnel through the operation panel (not shown in the drawing).

The controller 600 then checks the change in sub-scanning position of drive frequency for every unit (Step S2). Specifically, the controller 600 refers the drive frequency memory table T (see FIG. 6) previously stored in the memory unit 603 and controls the synchronizing sensor 8 to measure, for every unit, the amount of change of sub-scanning position after the vibration adjustment unit 63 adjusts the natural frequency of the fourth optical system 6 to the drive frequency of each unit stored in the drive frequency memory table T.

That is, the controller 600 functions as a first measurement control unit which controls the synchronizing sensor 8 to measure the amount of change of sub-scanning position after the vibration adjustment unit 63 adjusts the natural frequency of the fourth optical system 6 to the drive frequency of each unit, which is stored in the memory unit 603, at an initial state.

The controller 600 then stores the amount of change of sub-scanning position measured in the check process in Step S2 in the memory unit 603 as initial measurement information (Step S3). The measured amount of change of sub-scanning position may be stored in the RAM 602 instead of the memory unit 603.

That is, the controller 600 functions as an initial value memory control unit which stores the amount of change of sub-scanning position, which is measured through control of the first measurement control unit, in the memory unit 603 as the initial measurement information.

The controller 600 then switches off the vibration detection mode which is switched on in Step S1 (Step S4).

The controller 600 then determines whether the number of sheets printed has reached a predetermined value (Step S5). Specifically, the controller 600 refers the accumulated total number of sheets printed stored in a counter (not shown in the drawing) since the installation of the machine to determine whether the number has reached the predetermined value. The predetermined value corresponds to an approximate maintenance time for each unit.

When the controller 600 determines that the number of sheets printed has reached the predetermined value (YES in Step S5), the controller 600 switches on the vibration detection mode (Step S6). When the controller 600 determines that the number of sheets printed has not yet reached the predetermined value (NO in Step S5), the process in Step S5 is repeated until the number of sheets printed reaches the predetermined value.

The controller 600 then determines which unit to be checked according to the accumulated total number of sheets printed (Step S7). Specifically, the controller 600 refers the drive frequency memory table T illustrated in FIG. 6 to determine the unit to be checked according to the accumulated total number of sheets printed. When the controller 600 determines that, for example, the accumulated total number of sheets printed has reached 40 kp (40000 sheets) in Step S5, a drum driving unit A, a drum driving unit B, and a development driving unit B are determined as units to be checked. In the embodiment, the accumulated total number of sheets printed is exemplarily assumed to have reached 40 kp, to describe the following abnormality detecting process.

The controller 600 then performs the abnormality detecting process (Step S8).

Figure 8:
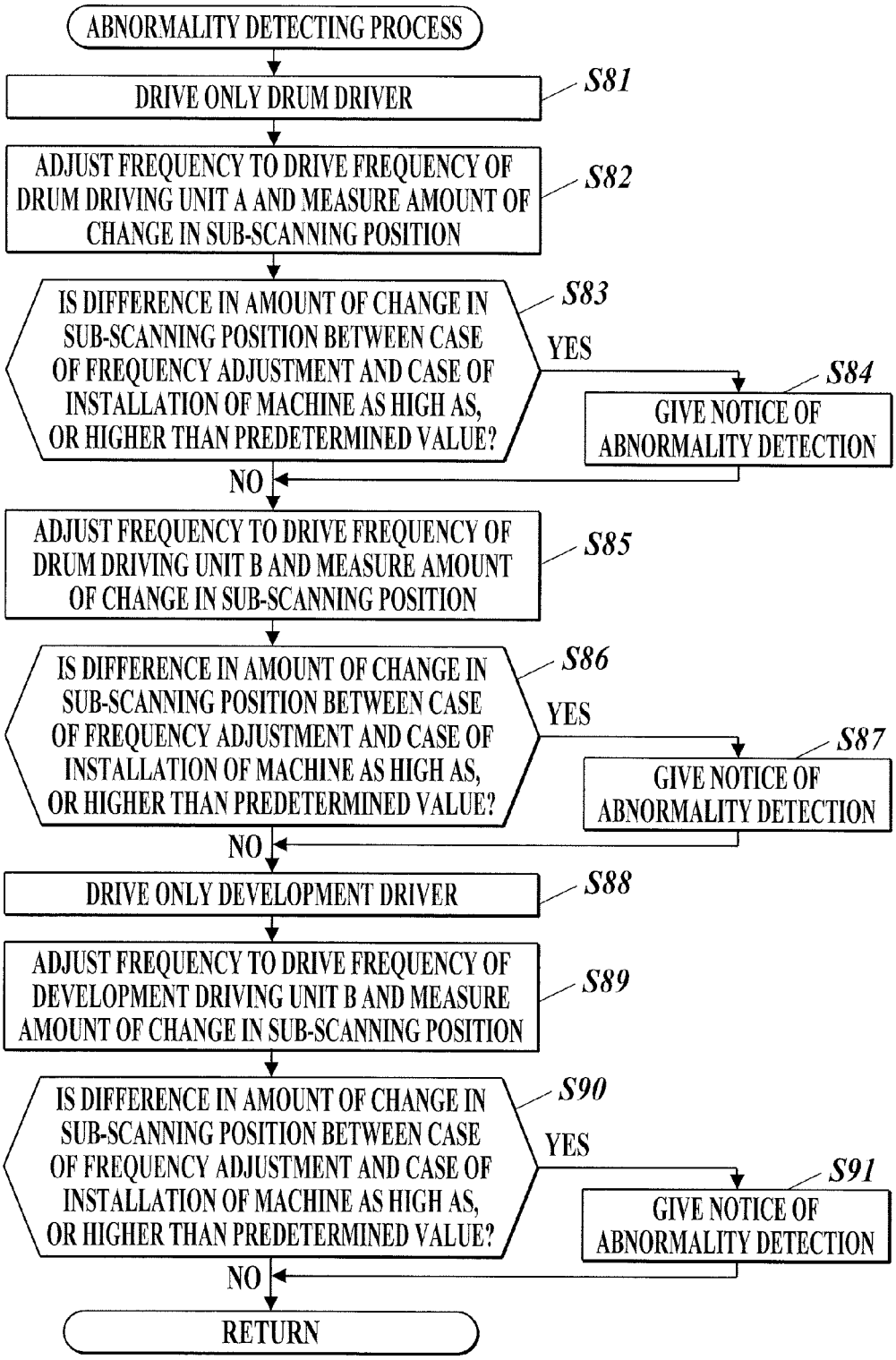
FIG. 8 is a flowchart illustrating an abnormality detecting process of the image forming apparatus according to the embodiment.

Specifically, as illustrated in a flowchart in FIG. 8, the controller 600 drives only the drum driver 201 (Step S81). Specifically, the controller 600 drives only the drum driver 201 including the drum driving unit A and the drum driving unit B to check the drum driving unit A and the drum driving unit B among all the units to be checked.

Figure 9:
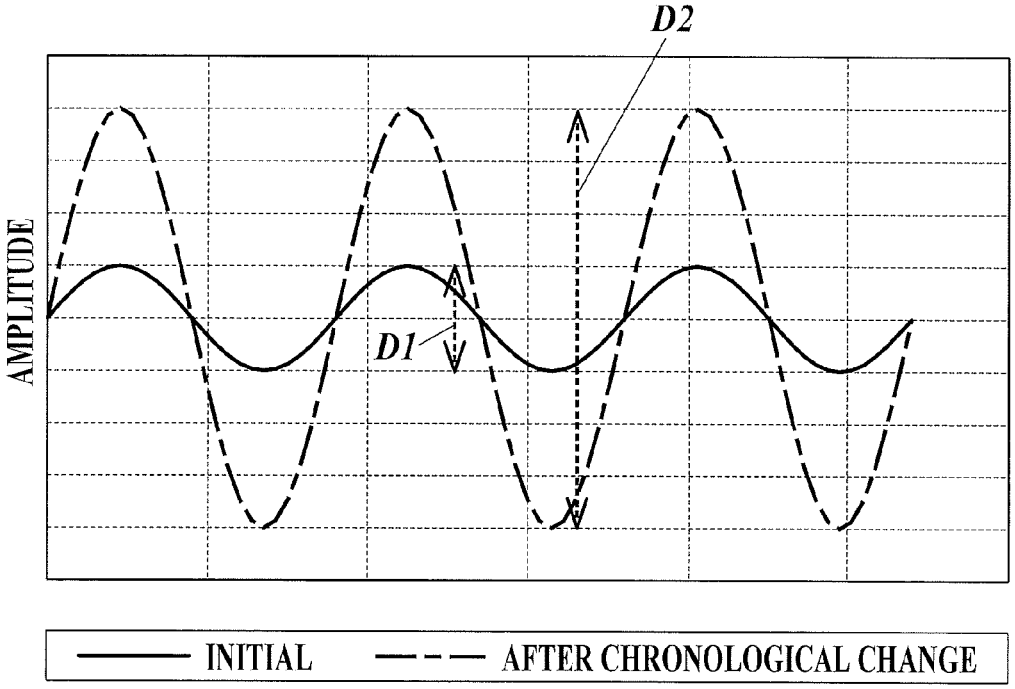
FIG. 9 illustrates an example of a measured amount of change of sub-scanning position of a laser beam.

The controller 600 then adjusts the frequency to the drive frequency of the drum driving unit A and measures the amount of change of sub-scanning position of the laser beam L after the adjustment (Step S82). Specifically, the controller 600 controls the vibration adjustment unit 63 to adjust the natural frequency of the fourth optical system 6 to the drive frequency of the drum driving unit A which is the first to be checked, while driving only the drum driver 201 in Step S81. The controller 600 then measures the amount of change of sub-scanning position of the laser beam L with the synchronizing sensor 8 after the adjustment. When the unit to be checked (here, the drum driving unit A) has degraded since the installation of the machine, the amplitude D2 measured after chronological change is greater than the amplitude D1 measured at the installation of the machine, as illustrated in FIG. 9.

That is, the controller 600 functions as a second measurement control unit which controls the synchronizing sensor 8 to measure the amount of change of sub-scanning position after the vibration adjustment unit 63 adjusts the natural frequency of the fourth optical system 6 to the drive frequency of the unit to be checked, which is stored in the memory unit 603, while driving the drive system included in the unit to be checked.

The controller 600 then compares the amount of change of sub-scanning position measured in Step S82 and the amount of change of sub-scanning position measured at the installation of the machine (Step S83). Specifically, the controller 600 compares the amount of change of sub-scanning position measured in Step S82 and the initial measurement information measured after the adjustment of the frequency to the drive frequency of the drum driving unit A among the amounts of change of sub-scanning position (initial measurement information) measured in Step S2 at the installation of the machine, thereby determining whether the difference between the values is as high as, or higher than, a predetermined threshold value. The predetermined threshold value is an approximate value indicating that the unit to be checked has abnormality.

That is, the controller 600 functions as a comparing unit which compares the amount of change of sub-scanning position, which is measured through control of the second measurement control unit, and the initial measurement information measured after the adjustment of the frequency to the drive frequency of the unit to be checked among all the stored initial measurement information.

When the controller 600 determines that the difference between the values is as high as, or higher than, the predetermined threshold value (YES in Step S83), the controller 600 gives notice that abnormality is detected (Step S84). The notice of abnormality detection may be given by, for example, requiring a user of maintenance by displaying abnormality detection on a display (not shown in the drawing), or by automatically notifying online the service site of the information.

That is, the controller 600 functions as an abnormality determination unit which determines abnormality of a unit to be checked according to comparison made by the comparing unit.

When the difference between the values is determined to be smaller than the predetermined threshold value (NO in Step S83), the process proceeds to Step S85.

The controller 600 then adjusts the frequency to the drive frequency of the drum driving unit B and measures the amount of change of sub-scanning position of the laser beam L after the adjustment (Step S85). Specifically, the controller 600 controls the vibration adjustment unit 63 to adjust the natural frequency of the fourth optical system 6 to the drive frequency of the drum driving unit B which is the second to be checked, while still driving only the drum driver 201. The controller 600 controls the synchronizing sensor 8 to measure the amount of change of sub-scanning position of the laser beam L after the adjustment.

The controller 600 then compares the amount of change of sub-scanning position measured in Step S85 and the initial measurement information measured after the adjustment of the frequency to the drive frequency of the drum driving unit B among the amounts of change of sub-scanning position (initial measurement information) measured in Step S2 at the installation of the machine, thereby determining whether the difference between the values is as high as, or higher than, the predetermined threshold value (Step S86).

When the controller 600 determines that the difference between the values is as high as, or higher than, the predetermined threshold value (YES in Step S86), the controller 600 gives notice that abnormality is detected (Step S87).

When the difference between the values is determined to be smaller than the predetermined threshold value (NO in Step S86), the process proceeds to Step S88.

The controller 600 then drives only the development driver 221 (Step S88). Specifically, the controller 600 drives only the development driver 221 including the development driving unit B to check the development driving unit B among all the units to be checked.

The controller 600 then adjusts the frequency to the drive frequency of the development driving unit B and measures the amount of change of sub-scanning position of the laser beam L after the adjustment (Step S89). Specifically, the controller 600 controls the vibration adjustment unit 63 to adjust the natural frequency of the fourth optical system 6 to the drive frequency of the development driving unit B which is the third to be checked, while still driving only the development driver 221 in Step S88. The controller 600 controls the synchronizing sensor 8 to measure the amount of change of sub-scanning position of the laser beam L after the adjustment.

The controller 600 then compares the amount of change of sub-scanning position measured in Step S89 and the initial measurement information measured after the adjustment of the frequency to the drive frequency of the development driving unit B among the amounts of change of sub-scanning position (initial measurement information) measured in Step S2 at the installation of the machine, thereby determining whether the difference between the values is as high as, or higher than, a predetermined threshold value (Step S90).

When the controller 600 determines that the difference between the values is as high as, or higher than, the predetermined threshold value (YES in Step S90), the controller 600 gives notice that abnormality is detected (Step S91).

When the difference between the values is determined to be smaller than the predetermined threshold value (NO in Step S90), the abnormality detecting process ends.

As described above, the image forming apparatus 1000 according to the embodiment includes the vibration adjustment unit 63 for adjusting the natural frequency of the fourth optical system 6 (optical system), the measuring unit for measuring the vibrational information indicating the change in vibration, the controller 600 that can independently control each of the plurality of units including the predetermined drive system, and the memory unit 603 for storing the drive frequency of each of the units including the predetermined drive system. Further, the controller 600 includes a first measurement control unit which controls the measuring unit to measure the vibrational information after the vibration adjustment unit 63 adjusts the natural frequency of the fourth optical system 6 to the drive frequency of each unit stored in the memory unit 603 at the initial state, an initial value memory control unit which stores the vibrational information measured by the first measurement control unit in the memory unit 603 as the initial vibrational information, a second measurement control unit which controls the measuring unit to measure the vibrational information after the vibration adjustment unit 63 adjusts the natural frequency of the fourth optical system 6 to the drive frequency of the unit to be checked, which is stored in the memory unit 603, a comparing unit for comparing the vibrational information measured by the second measurement control unit and the initial vibrational information measured after the adjustment of the frequency to the drive frequency of the unit to be checked among stored initial vibrational information, and an abnormality determination unit for determining abnormality in the unit to be checked according to comparison made by the comparing unit.

In this manner, the image forming apparatus 1000 according to the embodiment can predict degradation of the unit by detecting increase in vibration so that abnormality can be detected before image defects occur, thereby preventing image defects. Further, since the increase in vibration in each unit can be detected, abnormality can easily be identified, thereby reducing downtime. Furthermore, since the abnormality can easily be identified, unnecessary replacement of a unit without any abnormality not yet reaching the service life can be avoided, thereby preventing the increase in service cost.

Particularly, in the image forming apparatus 1000 according to the embodiment, the vibrational information is the amount of change of sub-scanning position of the laser beam L, and the second measurement control unit controls the measuring unit to measure the amount of change of sub-scanning position while driving the drive system included in the unit to be checked.

Therefore, the image forming apparatus 1000 according to the embodiment does not require printing of an image to detect abnormality so that unnecessary printing can be avoided, while reducing operation time and cost.

Further, the measuring unit of the image forming apparatus 1000 according to the embodiment includes a measuring unit which is the synchronizing sensor 8 included in the laser scanning optical unit 100, which means that abnormality can be detected using the synchronizing sensor 8 originally included in the apparatus so that an additional detector need not be attached. This prevents the rise in cost.

Although the embodiment according to the present invention is specifically described as above, the present invention is not limited to the embodiment, and alterations can be made without departing from the scope of the present invention.

Modification 1

Figure 10:
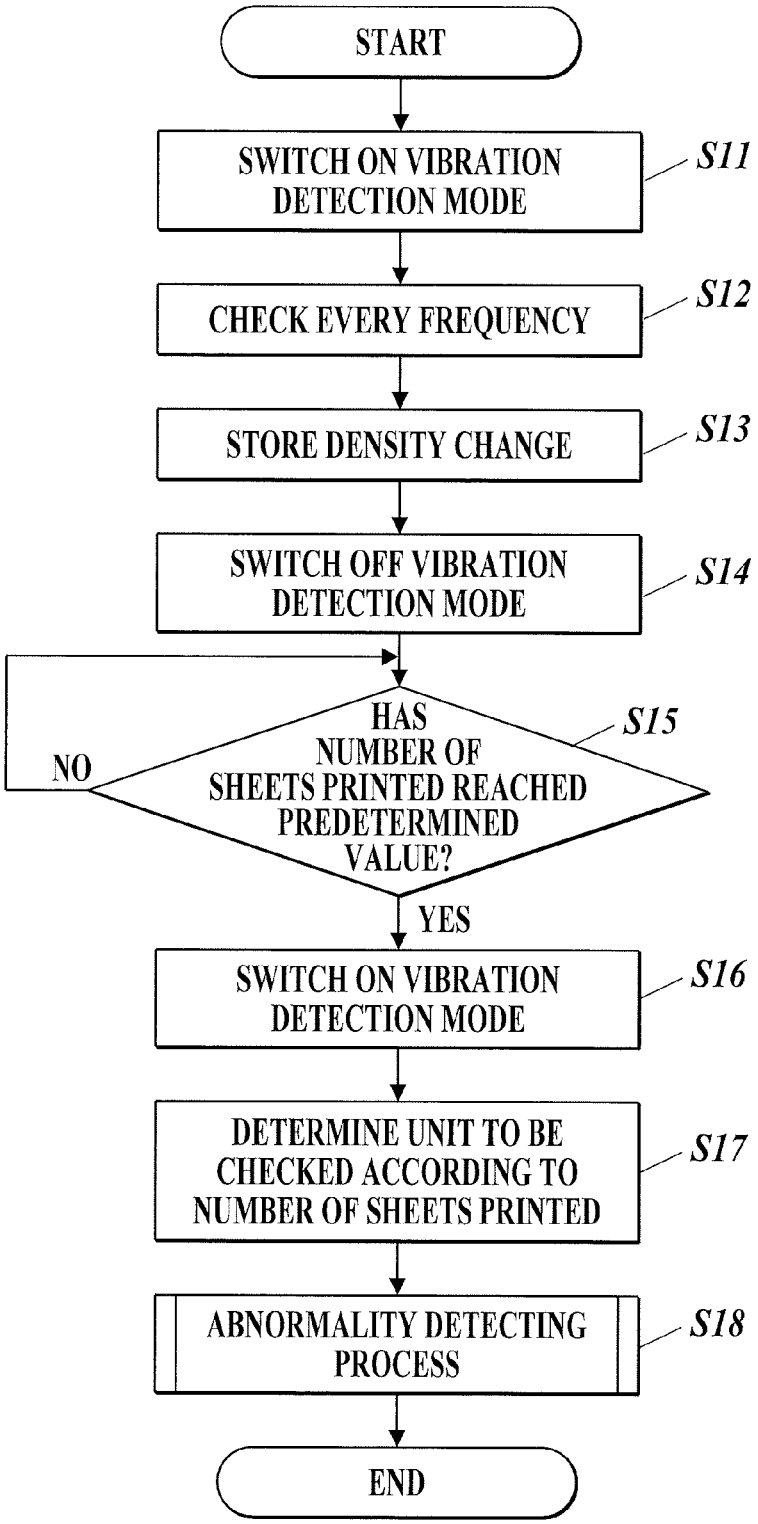
FIG. 10 is a flowchart illustrating an operation of the image forming apparatus according to Modification 1.
Figure 11:
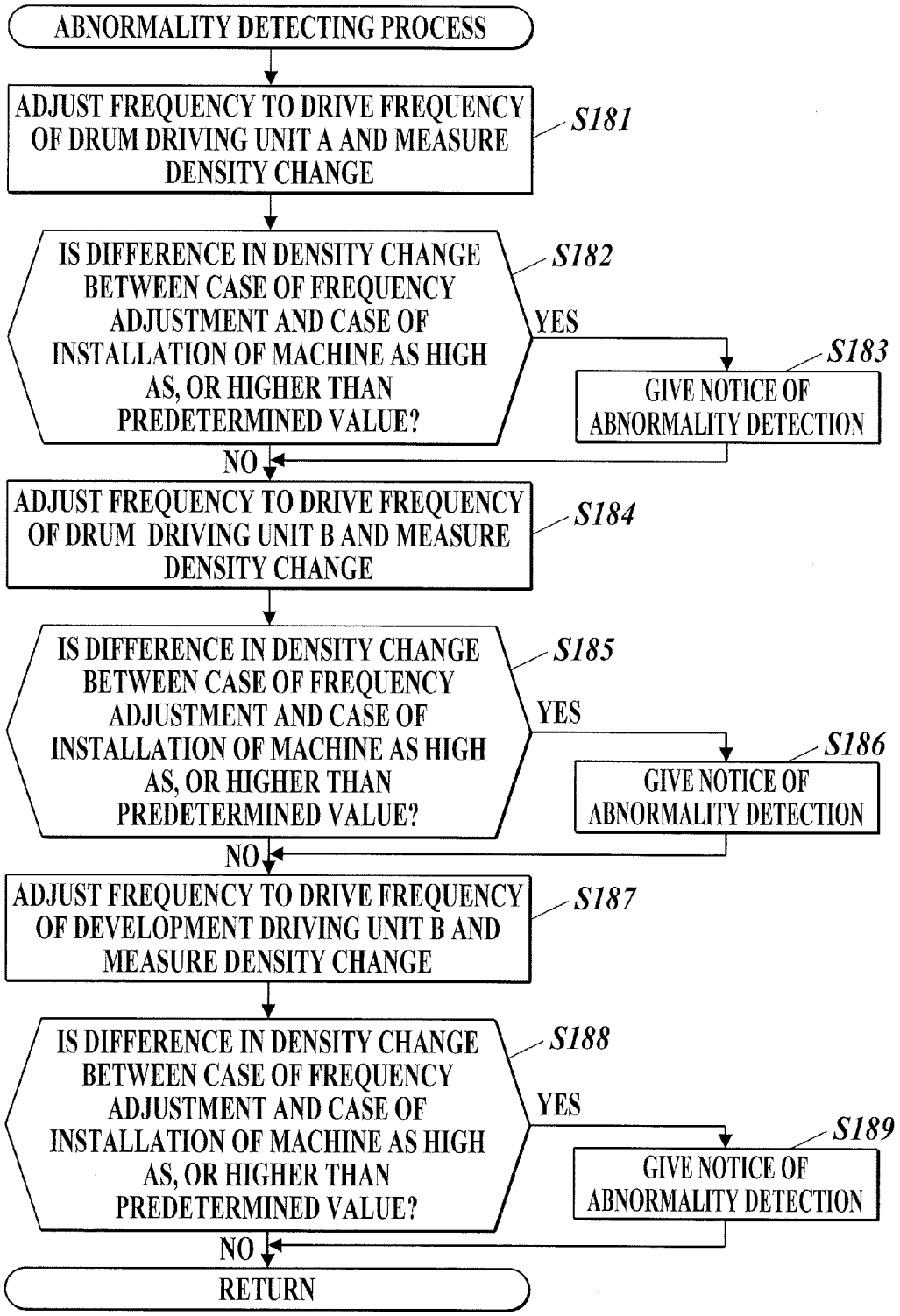
FIG. 11 is a flowchart illustrating the abnormality detecting process of the image forming apparatus according to Modification 1.

For example, an exemplary modification illustrated in FIGS. 10 and 11 is different from the above-mentioned embodiment in that the density change of an image printed on a print sheet P is used as the vibrational information instead of the amount of change of sub-scanning position of the laser beam L. Since the configuration of the image forming apparatus 1000 according to Modification 1 is similar to the above-mentioned embodiment, the same component is appended with the same reference sign and detailed description thereof is omitted.

The operation of the image forming apparatus 1000 according to Modification 1 will be described referring to a flowchart in FIG. 10.

Figure 7:
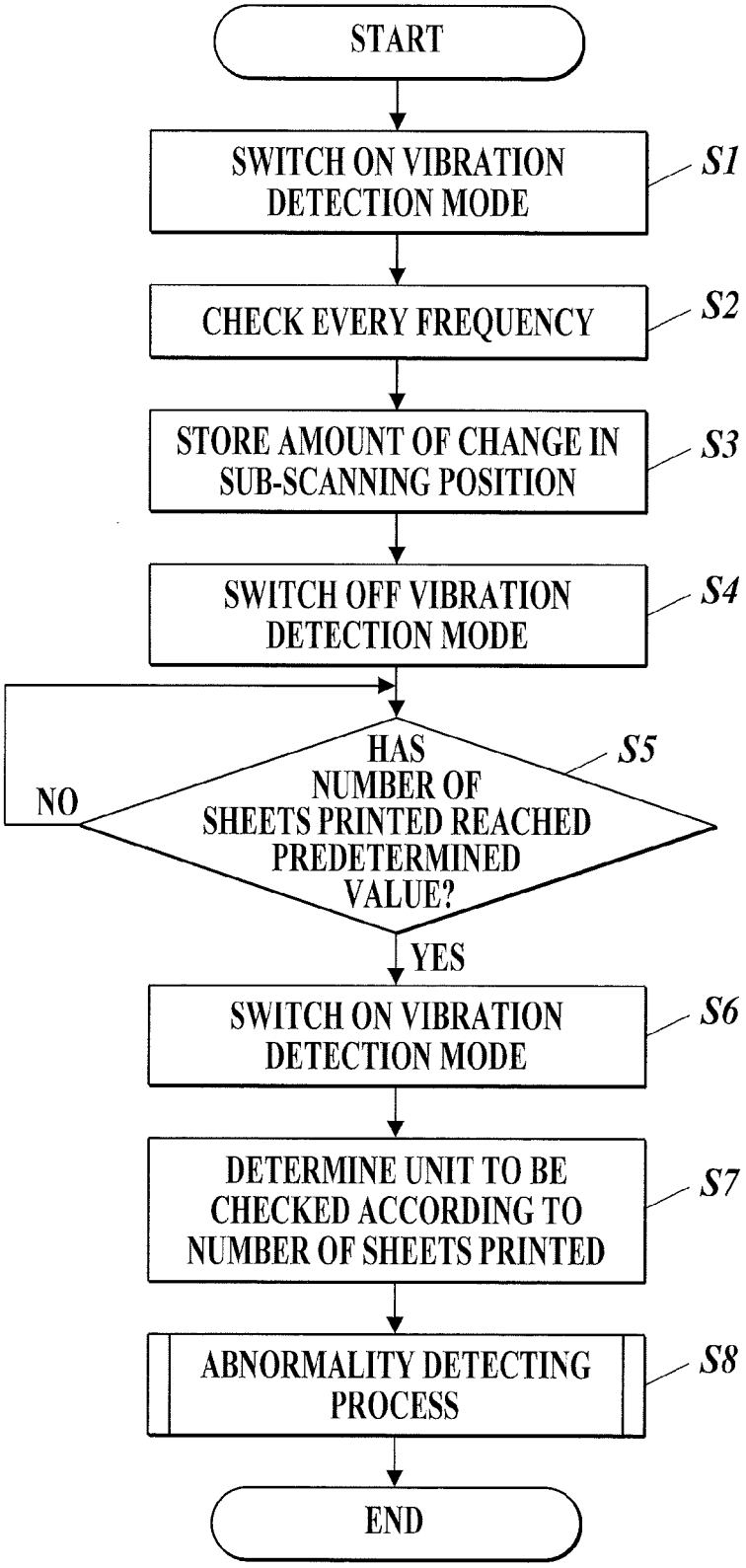
FIG. 7 is a flowchart illustrating an operation of the image forming apparatus according to the embodiment.

Since the process in Step S11 is similar to the process in Step S1 in FIG. 7 illustrating the operation of the image forming apparatus 1000 according to the above-mentioned embodiment, description on Step S11 is omitted.

The controller 600 refers the drive frequency memory table T (see FIG. 6) previously stored in the memory unit 603 and checks the density change for the drive frequency of all the units stored in the drive frequency memory table T (Step S12). Specifically, the controller 600 controls the in-line sensor 10 to measure the density change after the vibration adjustment unit 63 adjusts the natural frequency of the fourth optical system 6 to the drive frequency of each of all the units stored in the drive frequency memory table T.

The controller 600 then stores the density change measured in the check process in Step S12 in the memory unit 603 as initial measurement information (Step S13). The measured density change may be stored in the RAM 602 instead of the memory unit 603.

Since the processes from Steps S14 to S17 is similar to the processes from Steps S4 to S7 in FIG. 7, description on Steps S14 to S17 is omitted.

The controller 600 then performs the abnormality detecting process (Step S18). In Modification 1, similarly to the above-mentioned embodiment, the accumulated total number of sheets printed is exemplarily assumed to have reached 40 kp, to describe the following abnormality detecting process.

Specifically, as illustrated in a flowchart in FIG. 11, the controller 600 adjusts the frequency to the drive frequency of the drum driving unit A and measures the density change after the adjustment (Step S181). Specifically, the controller 600 controls the vibration adjustment unit 63 to adjust the natural frequency of the fourth optical system 6 to the drive frequency of the drum driving unit A which is the first to be checked. The controller 600 then measures the density change with the in-line sensor 10 after the adjustment. Although not illustrated in the drawing, when the unit to be checked (the drum driving unit A) has degraded since the installation of the machine, the amplitude measured after chronological change is greater than the amplitude measured at the installation of the machine, similarly to the case in FIG. 9 illustrating the result of the measurement of the amount of change of sub-scanning position of the laser beam L.

The controller 600 then compares the density change measured in Step S181 and the density change measured at the installation of the machine (Step S182). Specifically, the controller 600 compares the density change measured in Step S181 and the initial measurement information measured after the adjustment of the frequency to the drive frequency of the drum driving unit A among the density changes (initial measurement information) measured in Step S12 at the installation of the machine, thereby determining whether the difference between the values is as high as, or higher than, a predetermined threshold value. The predetermined threshold value is an approximate value indicating that the unit to be checked has abnormality.

When the controller 600 determines that the difference between the values is as high as, or higher than, the predetermined threshold value (YES in Step S182), the controller 600 gives notice that abnormality is detected (Step S183).

When the difference between the values is determined to be smaller than the predetermined threshold value (NO in Step S182), the process proceeds to Step S184.

The controller 600 then adjusts the frequency to the drive frequency of the drum driving unit B and measures the density change after the adjustment (Step S184). Specifically, the controller 600 controls the vibration adjustment unit 63 to adjust the natural frequency of the fourth optical system 6 to the drive frequency of the drum driving unit B which is the second to be checked. The controller 600 controls the in-line sensor 10 to measure the density change after the adjustment.

The controller 600 then compares the density change measured in Step S184 and the initial measurement information measured after the adjustment of the frequency to the drive frequency of the drum driving unit B among the density changes (initial measurement information) measured in Step S12 at the installation of the machine, thereby determining whether the difference between the values is as high as, or higher than, the predetermined threshold value (Step S185).

When the controller 600 determines that the difference between the values is as high as, or higher than, the predetermined threshold value (YES in Step S185), the controller 600 gives notice that abnormality is detected (Step S186).

When the difference between the values is determined to be smaller than the predetermined threshold value (NO in Step S185), the process proceeds to Step S187.

The controller 600 then adjusts the frequency to the drive frequency of the development driving unit B and measures the density change after the adjustment (Step S187). Specifically, the controller 600 controls the vibration adjustment unit 63 to adjust the natural frequency of the fourth optical system 6 to the drive frequency of the development driving unit B which is the third to be checked. The controller 600 controls the in-line sensor 10 to measure the density change after the adjustment.

The controller 600 then compares the density change measured in Step S187 and the initial measurement information measured after the adjustment of the frequency to the drive frequency of the development driving unit B among the density changes (initial measurement information) measured in Step S12 at the installation of the machine, thereby determining whether the difference between the values is as high as, or higher than, the predetermined threshold value (Step S188).

When the controller 600 determines that the difference between the values is as high as, or higher than, the predetermined threshold value (YES in Step S188), the controller 600 gives notice that abnormality is detected (Step S189).

When the difference between the values is determined to be smaller than the predetermined threshold value (NO in Step S188), the abnormality detecting process ends.

As described above, in the image forming apparatus 1000 according to Modification 1, the vibrational information is the density change of an image printed on a print sheet P, and the measuring unit is the in-line sensor 10 which reads the image printed on the print sheet P while the sheet is being delivered. Therefore, the in-line sensor 10 originally included in the apparatus can be used to detect abnormality and no additional detector needs to be attached. This prevents the rise in cost.

Modification 2

Figure 12:
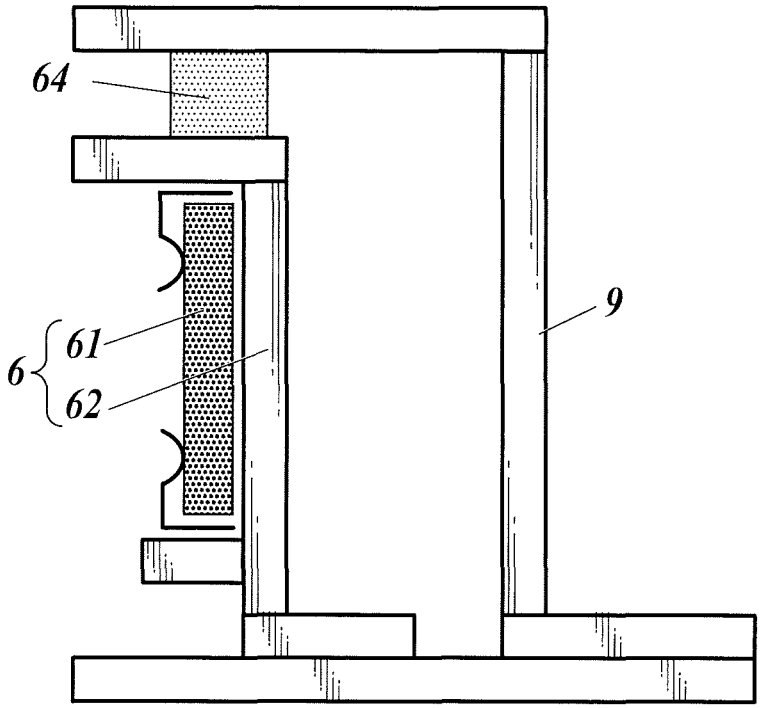
FIG. 12 illustrates a schematic configuration of the vibration adjustment unit according to Modification 2.

Further, an embodiment illustrated in FIG. 12 is different from the above-mentioned embodiment in that a rigidity changing unit 64 is provided as the vibration adjustment unit for adjusting the natural frequency of the fourth optical system 6, instead of the vibration adjustment unit 63, which includes the moving unit 631 and the linear motor 632.

Specifically, as illustrated in FIG. 12, the rigidity changing unit 64 is provided between the optical element holder 62 and the optical housing 9 and receives a voltage applied through control of the controller 600 to adjust the rigidity. The rigidity changing unit 64 changes the rigidity so as to adjust the pressing force applied to the optical element holder 62, and thereby adjusts the natural frequency of the fourth optical system 6.

Since well-known conventional art (e.g., Japanese Patent Application Laid-Open No. 2001-256762) can be applied to the specific configuration and operation of the rigidity changing unit 64, detailed descriptions are omitted.

Modification 3

Figure 13:
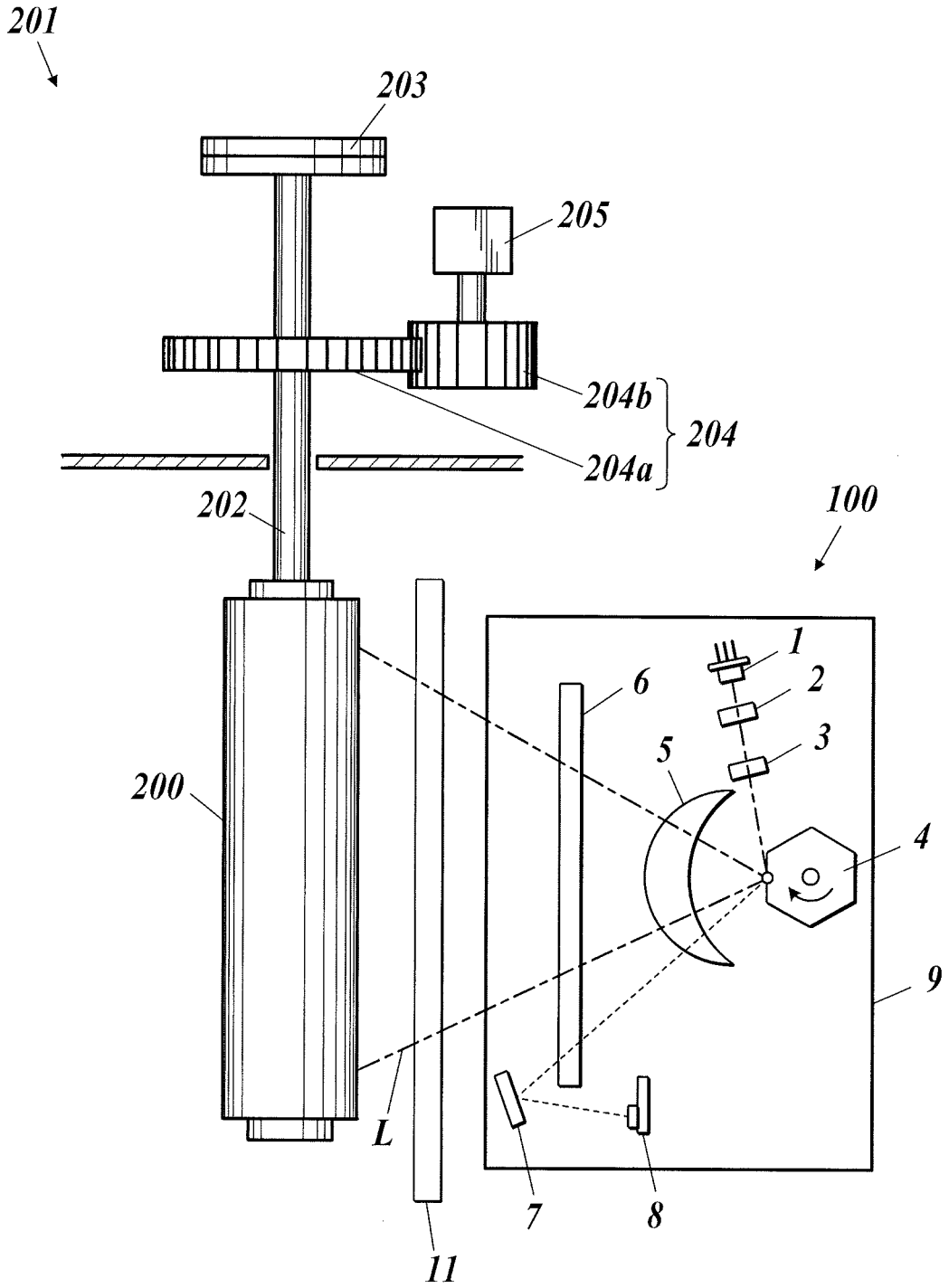
FIG. 13 illustrates a schematic configuration of the laser scanning optical unit, the photosensitive body, and the drum driver according to Modification 3.

An embodiment illustrated in FIG. 13 is different from the above-mentioned embodiment in that a shutter 11 is provided.

Specifically, as illustrated in FIG. 13, the shutter 11 is provided between the laser scanning optical unit 100 and the photosensitive body 200. The controller 600 controls the opening/closing of the shutter 11 to control the laser beam L passing through the shutter 11.

In the Modification 3, when the second measurement control unit controls the synchronizing sensor 8 to measure the amount of change of sub-scanning position, the controller 600 controls the shutter 11 such that the laser beam L does not reach the photosensitive body 200.

Therefore, the image forming apparatus 1000 according to Modification 3 suppresses the damage on the photosensitive body 200 caused by continuous irradiation with the laser beam L.

Instead of providing the shutter 11, the timing of emission from the light source 1 may be controlled. That is, an effect similar to that in Modification 3 can be obtained by the controller 600 controlling the timing of emission of the laser beam L from the light source 1 such that the laser beam L does not reach the photosensitive body 200.

Other Modifications

Although, in the above-mentioned embodiments, the synchronizing sensor 8 or the in-line sensor 10 originally included in the apparatus is used as the measuring unit for detecting abnormality, this is not the only possible configuration. For example, a vibration detector such as an accelerometer may be attached to each predetermined drive system.

Further, although the above-mentioned embodiments use, as vibrational information, the amount of change of sub-scanning position of the laser beam L or the density change of an image printed on the print sheet P, this is not the only possible configuration. For example, it may detect the vibrational change by analyzing pitches of well-known ladder patterns instead of using the amount of change of sub-scanning position or the density change.

Further, although Modification 1 measures the density change with the in-line sensor 10 while outputting the print sheet P when checking each unit, this is not the only possible configuration. For example, it may print images on the single print sheet P, each of which images measured after the adjustment of the natural frequency of the fourth optical system 6 to the drive frequency of each of the units, and then to measure the density change of the image corresponding to each unit printed on the print sheet P. In this manner, only one print sheet P is printed and therefore unnecessary printing of print sheets P can be avoided.

Further, although, in the above-mentioned embodiments, the drum driving unit and the development driving unit are exemplarily described as the unit to be checked, these are not the only units that can be checked. For example, an abnormality detecting process can be performed for other drive systems, such as a sheet feeder driving unit which drives a sheet feeder, in a similar manner as the process performed for the drum driving unit or the development driving unit.

Further, although, in the above-mentioned embodiments, the laser scanning optical unit 100 emitting the laser beam L is exemplarily described, this is not the only optical unit that can be used. Any optical unit that emits light converging to a point with an optical system may be used.

Other detailed configuration and operation of each unit constituting the image forming apparatus can suitably be modified without departing from the scope of the present invention.

According to one aspect of a preferable embodiment of the present invention, there is provided an image forming apparatus including an optical unit including a light source and an optical system which focuses light emitted from the light source onto a photosensitive body. The apparatus includes a vibration adjustment unit which adjusts a natural frequency of the optical system, a measuring unit which measures vibrational information indicating change in vibration, a controller which independently drives each of units including a predetermined drive system, and a memory unit which stores a drive frequency of each of the units including the predetermined drive system. The controller includes a first measurement control unit which controls the measuring unit to measure the vibrational information after the vibration adjustment unit adjusts the natural frequency of the optical system to a drive frequency of each unit, which is stored in the memory unit, at an initial state, an initial value memory control unit which stores the vibrational information measured through control of the first measurement control unit in the memory unit as initial vibrational information, a second measurement control unit which controls the measuring unit to measure the vibrational information after the vibration adjustment unit adjusts the natural frequency of the optical system to a drive frequency of a unit to be checked, which is stored in the memory unit, a comparing unit which compares the vibrational information measured through control of the second measurement control unit and the initial vibrational information measured after adjustment of the natural frequency of the optical system to the drive frequency of the unit to be checked among the stored initial vibrational information, and an abnormality determination unit which determines abnormality in the unit to be checked according to comparison made by the comparing unit.

This image forming apparatus can prevent the increase in service cost.

The entire disclosure of Japanese Patent Application No. 2013-245518 filed on Nov. 28, 2013 including description, claims, drawings, and abstract are incorporated herein by reference in its entirety.

What is claimed is:

1. An image forming apparatus including an optical unit including a light source and an optical system which focuses light emitted from the light source onto a photosensitive body, the apparatus comprising:

a vibration adjustment unit which adjusts a natural frequency of the optical system;

a measuring unit which measures vibrational information indicating change in vibration;

a controller which independently drives each of units including a predetermined drive system; and a memory unit which stores a drive frequency of each of the units including the predetermined drive system, wherein the controller comprises:

a first measurement control unit which controls the measuring unit to measure the vibrational information after the vibration adjustment unit adjusts the natural frequency of the optical system to a drive frequency of each unit, which is stored in the memory unit, at an initial state;

an initial value memory control unit which stores the vibrational information measured through control of the first measurement control unit in the memory unit as initial vibrational information;

a second measurement control unit which controls the measuring unit to measure the vibrational information after the vibration adjustment unit adjusts the natural frequency of the optical system to a drive frequency of a unit to be checked, which is stored in the memory unit;

a comparing unit which compares the vibrational information measured through control of the second measurement control unit and the initial vibrational information measured after adjustment of the natural frequency of the optical system to the drive frequency of the unit to be checked among the stored initial vibrational information; and an abnormality determination unit which determines abnormality in the unit to be checked according to comparison made by the comparing unit.

2. The image forming apparatus according to claim 1, wherein the vibrational information is an amount of change of sub-scanning position of the light, and wherein the second measurement control unit controls the measuring unit to measure the amount of change of sub-scanning position while driving the drive system included in the unit to be checked.

3. The image forming apparatus according to claim 2, wherein the measuring unit is a synchronizing sensor included in the optical unit.

4. The image forming apparatus according to claim 3, wherein the controller controls a timing of emission of light from the light source such that the light does not reach the photosensitive body when the second measurement control unit controls the measuring unit to measure the amount of change of sub-scanning position.

5. The image forming apparatus according to claim 3 further comprising a shutter provided between the optical unit and the photosensitive body to control passing of the light, wherein the controller controls the shutter such that the light does not reach the photosensitive body when the second measurement control unit controls the measuring unit to measure the amount of change of sub-scanning position.

6. The image forming apparatus according to claim 1, wherein the vibrational information is density change of an image printed on a print sheet.

7. The image forming apparatus according to claim 6, wherein the measuring unit is an in-line sensor which reads the image printed on the print sheet while the sheet is being delivered.

8. The image forming apparatus according to claim 6, wherein the measuring unit measures density change of images printed on a single print sheet, each of the images corresponding to each of the units and being printed after the natural frequency of the optical system is adjusted to the drive frequency of each of the units.

9. The image forming apparatus according to claim 1, wherein the memory unit stores the drive frequency and a measurement timing associated to each of the units, and wherein the controller controls the second measurement control unit to perform control according to the measurement timing.

10. The image forming apparatus according to claim 9, wherein the measurement timing is associated to an accumulated total number of sheets printed since installation of a machine.

* * * * *